US007645727B2

(12) United States Patent
Harris et al.

(10) Patent No.: US 7,645,727 B2
(45) Date of Patent: Jan. 12, 2010

(54) GEAR CUTTING OIL

(75) Inventors: Charles P. Harris, Ann Arbor, MI (US); Kathleen Maher Anguish, Whitmore Lake, MI (US); Anthony Krpan, Oakville (CA)

(73) Assignee: GM Global Technology Operations, Inc., Detroit, MI (US)

( * ) Notice: Subject to any disclaimer, the term of this patent is extended or adjusted under 35 U.S.C. 154(b) by 642 days.

(21) Appl. No.: 11/116,931

(22) Filed: Apr. 28, 2005

(65) Prior Publication Data

US 2005/0245403 A1 Nov. 3, 2005

Related U.S. Application Data

(60) Provisional application No. 60/567,492, filed on May 3, 2004.

(51) Int. Cl.
*C10M 135/04* (2006.01)
*C10M 169/04* (2006.01)
*B21B 45/02* (2006.01)

(52) U.S. Cl. ..... 508/322; 508/491; 508/567; 72/42

(58) Field of Classification Search ..... None
See application file for complete search history.

(56) References Cited

U.S. PATENT DOCUMENTS 4,487,705 A * 12/1984 Recchuite ..... 508/331
4,659,488 A * 4/1987 Vinci ..... 508/324
5,030,038 A * 7/1991 Ariura ..... 407/26
5,908,816 A 6/1999 Kobessho et al.
5,958,849 A 9/1999 Hewson et al.
6,562,766 B1 5/2003 Koyama et al.
6,710,021 B1 * 3/2004 Fisher ..... 508/152

OTHER PUBLICATIONS

Web Page—Lubrizol® "Ready Reference for Lubricant and Fuel Performance, Industrial Lubricants-Metalworking Fluid Additives", The Lubrizol Corporation, 1 pg., Mar. 9, 2004.
Data sheet, Transparent Cutting Oils (Tri-purpose and Heavy Duty Metalworking Fluids), Lubricants USA, 2 pgs., Dec. 31, 2002.
Web Page—Lake Shore Lubricants, Inc., "Metalworking", 3 pgs., Dec. 4, 2003.
Web Page—"Industrial Metal Working / Duracut Cutting Oils", Metal Working Oils, Sunny Side Corporation, 5 pgs., Dec. 4, 2003.
Web Page—"Black Swan, Light Cutting Oil", Black Swan Manufacturing Co., 3 pgs., Dec. 4, 2003.
Web Page—Emblem Dark Thread Cut, Emblem Petroleum Products, West Penn Oil, Inc., 1 pg., Dec. 4, 2003.
Technical Data Sheet Form 0083, "Multi Kut Metalworking Oils", Benz Oil, 1 pg., Undated.
Technical Data Sheet Form 0038, Speedi Kut Metalworking Oils, Benz Oil, 1 pg., May 2001.
Gulf Product Bulletin, "Gulfcut Transparent 2 Cutting Oil", American Refining Group, Inc., 2 pgs., Sep. 2002.

* cited by examiner

*Primary Examiner*—Glenn A Caldarola
*Assistant Examiner*—Vishal Vasisth

(57) ABSTRACT

Metalworking fluids contain active sulfur, a certain kind of inactive sulfur called "available sulfur", and fat in a base oil of a lubricating viscosity. The metalworking fluids are chlorine free and phosphorous free. Boundary lubrication is provided by the fat, while extreme pressure lubrication is provided by the sulfur. Available sulfur is inactive sulfur minus any contribution of inactive sulfur from sulfurized saturated fats. Active sulfur and available sulfur are present in balanced proportions, while fat is present at an amount effective to provide boundary lubrication. Use of the fluids reduces tool wear over a long period of action and over a variety of boundary and extreme pressure conditions.

26 Claims, No Drawings

GEAR CUTTING OIL

CROSS REFERENCE

This application claims the benefit of U.S. Provisional Application 60/567,492 filed on May 3, 2004. The disclosure of the above application is incorporated herein by reference.

FIELD OF THE INVENTION

The present invention relates to lubricant compositions that reduce wear on a tool during a metalworking operation. More specifically, the invention relates to chlorine free extreme pressure lubricant compositions.

INTRODUCTION

Metalworking encompasses a number of operations in which a tool contacts a workpiece and the shape or form of the workpiece is changed by the action of the tool. A metalworking lubricant is supplied to the contact area of the tool and workpiece during the operation. Metalworking fluids have three main functions. They carry away heat generated by frictional contact between the tool and workpiece; they reduce friction at the contact between the tool and the workpiece; and they prevent welding of the tool and workpiece that would otherwise result from the high temperature and pressure at the point of contact.

Metalworking fluids are formulated with a variety of additives that provide the benefits noted above. Depending on the temperature and pressure at the contact between the tool and the workpiece, the metalworking operation runs under so-called boundary conditions, extreme pressure conditions, or a combination of the two. Boundary conditions are those in which the temperatures generated at the contact zone are not sufficient to weld the tool and the workpiece. Boundary lubricants are typically fats or soaps that act to separate the tool and workpiece and reduce the coefficient of friction. When the temperature and/or pressure of contact is increased beyond a point at which the boundary additives are effective, such as at high tool speeds or increased cutting loads, so-called extreme pressure additives are used. Extreme pressure additives react with the tool and workpiece surface at the high temperature of the contact zone to form a film on the metal that prevents surfaces from deteriorating or welding together. Known extreme pressure additives are available that are based on the reaction of sulfur, chlorine, or phosphorous with the metal surfaces. Mixtures of extreme pressure additives may be used.

To prolong tool life and increase the quality of surface finishes on the workpiece, a variety of metalworking fluids can be formulated with boundary lubricants and extreme pressure additives containing sulfur, chlorine, or phosphorous. The industry is constantly searching for metalworking lubricants having improved performance in a variety of metalworking applications. For challenging operations such as gear cutting, the need for improved lubricants is especially great because of the high temperatures and pressures generated between the tool and the work piece during the gear cutting operation.

SUMMARY

Metalworking fluids contain active sulfur, a certain kind of inactive sulfur called "available sulfur", and fat in a base oil of a lubricating viscosity. The metalworking fluids are chlorine free and phosphorous free. Boundary lubrication is provided by the fat, while extreme pressure lubrication is provided by the sulfur. Active sulfur is reactive sulfur that is reactive with copper powder at 150° C. according to ASTM D-1662. Inactive sulfur is total sulfur minus active sulfur. Available sulfur is inactive sulfur minus any contribution of inactive sulfur from sulfurized saturated fats. Fat is the weight sum of saturated fats, unsaturated fats, and sulfurized versions of both present in the fluids. Active sulfur and available sulfur are present in balanced proportions, while fat is present at an amount effective to provide boundary lubrication.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

DESCRIPTION

In one aspect, the composition and methods of the invention are based on the discovery of a new parameter in metal working lubrication called in the description below as "available sulfur". Available sulfur can be thought of as a kind of inactive sulfur that is available for providing extreme pressure lubrication under conditions of high temperature and pressure. The discovery of available sulfur was based in part on the observation that a kind of sulfur provided by sulfurized saturated fats essentially did not contribute to the anti-wear properties of metal working fluids formulated with well-known lubricant additives such as sulfurized lard oil. Thus in one aspect, the specification gives guidance for formulating metal working fluids useful in severe operations such as gear cutting. Use of the fluids reduces tool wear over a long period of action and over a variety of boundary and extreme pressure conditions.

In various aspects described below, metal working fluids are formulated that contain suitable levels of fat for boundary lubrication and of sulfur for extreme pressure lubrication. The total sulfur in the fluid is divided among active sulfur and inactive sulfur according to standard industry tests. For example, active sulfur is generally considered to be that amount of sulfur that is "loosely held" on the additive components in such a way that the sulfur discolors copper in a standard test. According to this standard test, inactive sulfur is any of the total sulfur that is not active sulfur. The invention is based in part on the discovery that a certain class of inactive sulfur, that is the inactive sulfur contributed by the tightly bound sulfur on sulfurized saturated fats, is not available to provide extreme pressure lubrication in an effective way to avoid wear on the tool during a challenging operation such as gear cutting.

In various aspects, the invention is also based on the discovery that, no matter the level of sulfur, preferred results are achieved when the active sulfur and the available sulfur are in a certain balance, as described further below. In various preferred embodiments, the level of fat is also in balance with the active sulfur and available sulfur. According to certain embodiments of the invention, extreme pressure metal working compositions are formulated by taking into account the amount of active sulfur, inactive sulfur, and available sulfur contributed by each and any of the individual lubricating additive components that make up the composition.

As developed below, additive components contain one or more of fat, active sulfur, inactive sulfur, and available sulfur depending on the structure. The formulator takes into account any inactive sulfur provided in any of the components by a sulfurized saturated fat component. The inactive sulfur from the saturated fat components is removed from the inactive sulfur determined by standard methods to arrive at available sulfur. The available sulfur is then formulated in balance with the active sulfur and fat as described below.

As used here, active sulfur and inactive sulfur refer to values obtained in weight percent according to standard method ASTM D-1552. Fat refers to unsaturated and saturated fats, either natural or sulfurized. The percentage level of fat in the fluids of the invention is the sum of the weight percentage of each of unsaturated fat, saturated fat, and sulfurized fat, if any, present as additives. Metalworking fluids containing the targeted values of active sulfur, available sulfur, and fat may be formulated from a variety of commercially available additives using procedures familiar to those of skill in the art. To illustrate, additives are known to contain a certain amount of active sulfur, inactive sulfur, and/or fat. Any inactive sulfur contributed by a sulfurized saturated fat such as lard oil is removed in a calculation to arrive at available sulfur. Such additives are combined in a variety of proportions to achieve metalworking fluid compositions having the levels of active sulfur, available sulfur, and fat described below.

In one embodiment, the invention provides a metalworking lubricant composition comprising a lubricating base oil, fat, available sulfur, and active sulfur. The lubricant compositions contain less than 20 ppm chlorine and preferably less than 10 ppm chlorine. In various embodiments, the compositions are chlorine free. In addition the compositions contain less than 200 ppm, preferably less than 100 ppm, preferably less than 50 ppm, preferably less than 20 ppm, and more preferably less than 10 ppm phosphorous. Although the invention is not limited by theory, the fat component is believed to provide boundary lubrication while the sulfur provides extreme pressure (EP) lubrication.

In one embodiment, the invention provides a metal working lubricant composition containing a lubricant base oil, less than 10 ppm chlorine, and less than 200 ppm phosphorous. In various embodiments, the metal working lubricants are essentially chlorine free and phosphorous free. The metal working lubricant further contains fat, available sulfur, and active sulfur. For convenience, the level of active sulfur in the fluid is represented as A % by weight. Similarly the amount of available sulfur is represented as a level of B % by weight and the fat is represented as a level of C % by weight, where each percentage by weight is based on the weight of the total metal working lubricant composition.

The levels of fat, active sulfur, and available sulfur have certain minimum levels and are in balance as described algebraically below. In various embodiments, the level of fat (C) is 2% by weight or higher and the sum of active sulfur and available sulfur (A+B) is at least 0.4. In addition, the value of the ratio of active sulfur to available sulfur (A/B) ranges from ¼ to 4⅓ to 3 or about 0.33 to about 3. Equivalently, the ratio B/A takes on the same range as A/B.

In various embodiments, the value of (A/B) ranges from about 0.5 to about 2, from about 0.6 to about 1.6, and from about 0.7 to about 1.5. In any of the embodiments above, the sum of (A+B) is preferably greater than about 0.8 or greater than about 2. In various embodiments, fat is balanced against sulfur such that the level C of fat is at least 2.5×(A+B), preferably greater than or equal to 3×(A+B).

In another embodiment, the method provides a method of reducing wear of a metal working tool in contact with a work piece during a metalworking operation such as gear cutting. The method comprises lubricating the workpiece with an extreme pressure lubricant composition containing fat, active sulfur, and available sulfur in the proportions described above. In various embodiments, the metal working tool comprises a gear cutting hob, preferably made of hard tool steel with an anti-wear coating. Anti-wear coatings for tool steels are known in the art. Non-limiting examples include titanium nitride (TiN), titanium aluminum nitride (TiAlN), aluminum chromium nitride (AlCrN), chromium carbide (CrC), titanium chromium nitride (TiCRN), and mixed coatings such as TiCN+TiN.

In another embodiment, the invention provides a method of reducing wear on a hobbing tool during a gear cutting operation on a work piece, wherein the hob comprises a hard steel suitable for use in cutting operations, preferably provided with a wear coating such as noted above. The method involves applying a lubricant composition as described herein to the zone of contact between the hobbing tool and the work piece and removing metal from the work piece by the cutting action of the tool.

As noted above, the fat (C) and sulfur (A+B) are formulated to be in a certain balance. In one embodiment, the sum of (A+B) is about 1.8 to about 2.4, (C) is from about 6 to about 10, and the ratio (A/B) is from about 1 to about 1.5.

In another embodiment, the sum (A+B) is from about 0.8 to about 1.2, (C) is about 5 to about 9, and the ratio (A/B) is from about 0.5 to about 1.25.

In another embodiment, the sum (A+B) (representing as above the sum of active sulfur and available sulfur) ranges from about 0.4 to about 0.6, (C) (level of fat) ranges from about 2 to about 4, and the ratio (A/B) (as above the ratio of active sulfur to available sulfur) ranges about 0.5 to about 1.5.

In another embodiment, (A+B) ranges from about 0.4 to 0.6, fat is from about 2 to about 3, and the ratio (A/B) is from about 1.25 to about 1.75.

In one embodiment, fat is about 2.6%, active sulfur is about 0.3%, and available sulfur is about 0.2%, where the percentages here and below are by weight based on the total weight of the lubricating composition.

In another embodiment, fat is from about 6 to about 8, (A+B) ranges from about 0.9 to about 1.2, and the ratio (A/B) is from about 0.5 to about 1.

In another embodiment, fat is about 6.9, active sulfur is about 0.4, and available sulfur is about 0.56.

In another embodiment, the sum (A+B) is from about 2 to about 2.4, (C) is from about 7 to about 9 and the ratio (A/B) is from about 1 to about 1.5.

In another embodiment, fat is about 7.8, active sulfur is about 1.3, and available sulfur is about 0.9.

In another embodiment, the invention provides a method of formulating a gear cutting lubricant by admixing a lubricating base oil and one or more lubricant components. In the method, one or more lubricant components are first selected that contain known levels of at least one of active sulfur, inactive sulfur, and fat. For example, active sulfur and inactive sulfur can be determined according to ASTM D-1552 and D-1662. Fat is contributed by components that contain saturated or unsaturated fats as well as sulfurized versions of the saturated or unsaturated fats. For each component, a level of available sulfur is calculated by subtracting from inactive sulfur the amount of inactive sulfur, if any, supplied by a sulfurized saturated fat. To illustrate, various sulfurized saturated fats such as lard oils are commercially available that contain about 10% by weight sulfur, essentially all of it inactive according to standard test methods such as ASTM D-1552 and D-1662. After the available sulfur is determined in this way for each component, the lubricant components are then combined at levels calculated to give a total fat level of at least 2% by weight, and a sum of active sulfur and available sulfur of at least 0.4% by weight. Furthermore, the components are used at levels calculated to give a balance of sulfur such that the ratio of the level of active sulfur to the level of available sulfur is from about 0.5 to about 2.0, or from about 1:4 to 4:1.

In various preferred embodiments, the active sulfur and available sulfur are formulated to be in a ratio of about 0.6 to about 1.6. Preferably, the fat and the sulfur levels are in balance such that the ratio of fat (C) to the sum of active sulfur and available sulfur (A+B) is greater than or equal to 2.5, preferably greater than about 3. In various preferred embodiments, the sum of (A+B) is greater than or equal to 0.8 and preferably greater than or equal to 2.0.

A wide variety of metalworking lubricant additives are known and commercially available that provide active sulfur, inactive sulfur, fat, or combinations of the components. In a typical embodiment, the fluid contains fat or sulfurized fats together with other sulfur containing extreme pressure agents.

Fats useful in the fluids of the composition include triglycerides derived from animal or vegetable sources. Non-limiting examples of plant derived triglycerides and fats include grape seed oil, castor oil, soy bean oil, rice bran oil, and the like. A commonly used saturated fat is lard oil. In addition to triglycerides, fatty acids may be used as well as their esters. Non-limiting examples of fatty acids and esters include oleic acids, rice bran fatty acids, as well as their alkyl esters (e.g. ethyl and octyl). The triglycerides, fats, and esters may be sulfurized or unsulfurized. Animal fats tend to be saturated while plant derived fats are more unsaturated. Any of the saturated or unsaturated fats as well as their sulfurized derivatives can be used to provide suitable levels of fat (C) in the lubricant compositions of the invention.

Components that contribute saturated or unsaturated fats include triglycerides, fatty acids, and esters such as described above. The fat components are alternatively sulfurized. Although the invention is not to be limited by theoretical considerations, it is noted that when sulfur is added chemically to unsaturated materials such as unsaturated triglycerides, fatty acids, or esters, the sulfur adds to double bonds of the fat compounds in such a way that some of the added sulfur reports as active sulfur and other of the added sulfur reports as inactive sulfur according to standard tests such as ASTM D-1552 and D-1662. The situation for saturated fats such as saturated triglycerides, fatty acids, and esters is believed to be different. In these cases, there is no unsaturation for the sulfur to add to. It is believed that in various embodiments, sulfur adds to saturated fats such as lard oil and the like in a way that produces essentially no sulfur that acts or reports as active sulfur in the standardized tests. Further, because addition of sulfur to olefinic unsaturation is not possible in such compounds, it is believed that sulfur added by sulfurizing a saturated fat such as lard oil adds chemically in a different way than it does to unsaturated compounds such as vegetable derived fats. The different chemical nature of the attachments to the saturated compounds could lead to its unavailability to provide extreme pressure lubrication under the severe conditions such as gear cutting. The model exploited in the current invention recognizes that a sulfurized saturated fat lubricant additive can provide such sulfur without contributing to the overall anti-wear protection of the fluids. This property is acknowledged by designating certain kinds of inactive sulfur as "available" in so far as it is not sulfur contributed by sulfurized saturated fats, such as lard oil.

A variety of sulfur containing extreme pressure agents is known and commercially available. Non-limiting examples of sulfur containing extreme pressure agents include sulfurized (unsaturated) oils and fats, sulfurized (unsaturated) fatty acids, sulfurized (unsaturated) esters, sulfurized olefins, dihydrocarbyl polysulfides, thiocarbamates, thioterpenes, dialkylthio dipropionates, and the like. The sulfurized oils and fats may be obtained by reacting sulfur or a sulfur-containing compound with oils and fats. Although the sulfur content of the additive is not particularly critical, preferred are those having a sulfur content of from 5% to 30% by weight. Specific examples include sulfurized rapeseed oil, sulfurized castor oil, sulfurized soybean oil, and sulfurized rice bran oil. Examples of the sulfurized fatty acids include sulfurized oleic acid; those of the sulfurized esters include sulfurized methyl oleate and, sulfurized octyl esters of rice bran fatty acids.

The sulfurized olefins include, for example, compounds of a general formula $$R^1—S_x—R^2 \quad (I)$$

wherein $R^1$ represents an alkenyl group having from 2 to 15 carbon atoms; $R^2$ represents an alkyl or alkenyl group having from 2 to 15 carbon atoms; and x represents an integer of, illustratively, from 1 to 8.

The compounds are obtained by reacting an olefin having from 2 to 15 carbon atoms or its di- to tetra-mer with a sulfurizing agent such as sulfur, sulfur chloride or the like. Non-limiting examples of olefin include propylene, isobutene, and diisobutene.

The dihydrocarbyl polysulfides are compounds of a general formula $$R^3—S_y—R^4 \quad (II)$$

wherein $R^3$ and $R^4$ each represent an alkyl or cyclic alkyl group having from 1 to 20 carbon atoms, an aryl group having from 6 to 20 carbon atoms, an alkylaryl group having from 7 to 20 carbon atoms, or an arylalkyl group having from 7 to 20 carbon atoms, and wherein $R^3$ and $R^4$ may be the same or different; and y represents an integer of from 2 to 8.

The compounds of formula (II) where $R^3$ and $R^4$ are alkyl groups are referred to as alkyl sulfides.

Non-limiting examples of $R^3$ and $R^4$ in formula (II) include a methyl group, an ethyl group, an n-propyl group, an isopropyl group, an n-butyl group, an isobutyl group, a sec-butyl group, a tert-butyl group, all types of pentyl groups, all types of hexyl groups, all types of heptyl groups, all types of octyl groups, all types of nonyl groups, all types of decyl groups, all types of dodecyl groups, a cyclohexyl group, a cyclooctyl group, a phenyl group, a naphthyl group, a tolyl group, a xylyl group, a benzyl group, and a phenethyl group.

Non-limiting examples of the dihydrocarbyl polysulfides include dibenzyl polysulfides, di-tert-nonyl polysulfides, didodecyl polysulfides, di-tert-butyl polysulfides, dioctyl polysulfides, diphenyl polysulfides, and dicyclohexyl polysulfides.

The thiocarbamates include, for example, zinc thiocarbamate. The thioterpenes include, for example, reaction products of phosphorus pentasulfide and pinene. The dialkylthio dipropionates include, for example, dilaurylthio dipropionate, and distearylthio dipropionate.

The active sulfur and inactive sulfur content of any of the sulfurized lubricant components discussed above is determined by standard industry tests such as ASTM D-1552 and D-1662. According to various aspects of the invention, lubricant compositions are formulated using suitable amounts of the fats and sulfurized additives described above to provide compositions having a balance of fat, active sulfur, and available sulfur. To determine available sulfur, first inactive sulfur according to a standard test method is determined. From that determined inactive sulfur measurement, any inactive sulfur contributed by a sulfurized saturated component is subtracted out. Suitable fluid formulations are then formulated by combining individual lubricant components according to proportions that can be determined algebraically.

Lubricating compositions containing fat, active sulfur, and available sulfur are formulated by combining additive components in a lubricating base oil, together with optional further ingredients described below. Sufficient levels of additives are combined into a formulation to provide certain minimum levels of fat, active sulfur, and available sulfur in various embodiments. Upper levels of fat, active sulfur, and available sulfur are not particularly limited in certain embodiments, it being always kept in mind that it is normally preferred to use the lowest effective amounts for economic and other reasons. The lubricating compositions normally contain a major amount of a lubricating base oil, for example from 20 to 99 percent by weight of the total composition. In preferred embodiments, the compositions contain more than 50% by weight base oil, for example from 50-95%, from 60-95%, from 70-95%, or from 60-90%, based on the total weight of the compositions. The remainder of the compositions is made up of sulfur- and/or fat-containing additives along with optional other additives such as described below.

Fat and the sulfurs are present at the minimum levels indicated, and up to levels that are practical. Upper levels of the fat and sulfurs (i.e. active sulfur and available sulfur) are determined by solubility, performance, and factors such as economics. In preferred embodiments, the fluids contain up to 20%, preferably up to 10%, and more preferable up to 5% of active plus available sulfur (A+B), and up to 40%, preferably up to 30%, and more preferably up to 20% fat (C), with all percentages based on the weight of the total composition. Compositions containing levels at high end of these limits are used in various embodiments as concentrates or pre-mixed fluids, which can be diluted as desired with lubricating base oil to prepare fluids for use in metalworking operations.

The basestocks employed in the metalworking or cutting fluids of the present invention are oils of lubricating viscosity. Suitable basestocks have kinematic viscosity at 40° C. of about 1 to about 500 cSt, preferably in the 2 to 250 cSt range, preferably 5 to 250 cSt, preferably 8 to 200 cSt range, and most preferably 10 to 185 cSt. The lubricant compositions have viscosities in those same ranges.

The lubricating oil basestock can be derived from natural lubricating oils, synthetic lubricating oils, or mixtures thereof. Suitable lubricating oil basestocks include basestocks obtained by isomerization of synthetic wax and slack wax, as well as hydrocrackate basestocks produced by hydrocracking (rather than solvent extracting) the aromatic and polar components of the crude.

Natural lubricating oils include petroleum oils, mineral oils, and oils derived from coal or shale which are refined by typical procedures including fractionating distillation, solvent extraction, dewaxing and hydrofinishing.

Synthetic oils include hydrocarbon oils and halo-substituted hydrocarbon oils such as polymerized and interpolymerized olefins, alkylbenzenes, polyphenyls, alkylated diphenyl ethers, alkylated diphenyl ethers, alkylated diphenyl sulfides, as well as their derivatives, analogs, and homologs thereof, and the like. Synthetic lubricating oils also include alkylene oxide polymers, interpolymers, copolymers and derivatives thereof wherein the terminal hydroxyl groups have been modified by esterification, etherification, etc. Another suitable class of synthetic lubricating oils comprises the esters of dicarboxylic acids with a variety of alcohols. Esters useful as synthetic oils also include those made from $C_5$ to $C_{12}$ monocarboxylic acids and polyols and polyol ethers.

Silicon-based oils (such as the polyalkyl-, polyaryl-, polyalkoxy-, or polyaryloxy-siloxane oils and silicate oils) comprise another useful class of synthetic lubricating oils. Other synthetic lubricating oils include liquid esters of phosphorus-containing acids, polymeric tetrahydrofurans, poly alpha-olefins, and the like.

The lubricating oil may be derived from unrefined, refined, rerefined oils, or mixtures thereof. Unrefined oils are obtained directly from a natural source or synthetic source (e.g., coal, shale, or tar and bitumen) without further purification or treatment. Examples of unrefined oils include a shale oil obtained directly from a retorting operation, a petroleum oil obtained directly from distillation, or an ester oil obtained directly from an esterification process, each of which is then used without further treatment. Refined oils are similar to the unrefined oils except that refined oils have been treated in one or more purification steps to improve one or more properties. Suitable purification techniques include distillation, hydrotreating, dewaxing, solvent extraction, acid or base extraction, filtration, and percolation, all of which are known to those skilled in the art. Rerefined oils are obtained by treating refined oils in processes similar to those used to obtain the refined oils. These rerefined oils are also known as reclaimed or reprocessed oils and often are additionally processed by techniques for removal of spent additives and oil breakdown products.

In various embodiments, the lubricant compositions and metalworking fluids of the invention further comprise oil soluble metal deactivators such as triazoles or thiadiazoles. If present, they are typically used in an amount in the range 0.01 to 0.5 vol %. Such materials include triazoles, aryl triazoles such as benzotriazole and tolyltriazole, alkyl derivatives of such triazoles, and benzothiadiazoles such as $R(C_6H_3)N_2S$ where R is H or $C_1$ to $C_{10}$ alkyl. Suitable materials are available from Ciba Geigy under the tradenames Irgamet and Reomet or from Vanderbilt Chemical Corporation under the Vanlube tradename.

In various embodiments, the compositions and fluids further comprise antimisting agents. Antimisting agents may be optionally employed in an amount based on active ingredients in the range 0.05 to 5.0% by vol. Antimisting agents are typically oil soluble organic polymers ranging in molecular weight (viscosity average molecular weight) from about 0.3 to over 4 million. Typical polymers include those derived from monomers such as isobutylene, styrene, alkyl methacrylate, ethylene, propylene, n-butylene vinyl acetate, etc. Preferred materials are polymethylmethacrylate or poly(ethylene, propylene, butylene or isobutylene) in the molecular weight range 1 to 3 million. Most preferred is polyisobutylene of molecular weight between 1.6 to 3 million, more preferably about 2.1 to 2.35 million. Such polymers are typically used as a solution of 4 to 6 wt % polymer in mineral oil diluent. Methacrylates are available from Rohm GmbH or Rohm and Haas while polyolefin materials can be secured from Exxon Chemical Company.

Antioxidants are also useful in certain applications of the lubricating compositions and metalworking fluids of the invention, such as when the oil serves the dual purpose of cutting fluid and machine lube oil.

Generally, any antioxidant of the aminic or phenolic type or mixtures thereof can be employed, and, if present, is used in an amount in the range 0.01 to 1.0 weight %. Phenolic antioxidants are well known. Non-limiting examples of phenolic antioxidants include butylated hydroxy toluene (BHT), bis-2,6-di-t-butylphenol derivatives, sulfur containing hindered phenols, and sulfur containing hindered bisphenol.

Metalworking operations include a wide variety of processes, some of which involve removing metal from a workpiece, while others involve changing the shape or form of the workpiece without removing metal. Non-limiting examples of metal removal processes include cutting, drilling, boring, honing, broaching, and grinding. Non-limiting examples of metalworking operations involving change in shape or form of a workpiece without excessive metal removal include forming, stamping, and drawing. In all metalworking operations there is contact during the operation between a tool and a workpiece. The workpiece is defined as that member of the pair that undergoes the metal removal or the reshaping, while the tool operates to remove the metal or change the shape of the workpiece, without in general undergoing a physical change.

Inevitably however, in metal to metal contact, especially at high loads or temperatures, the tool will be changed by contact with the workpiece despite the action of the lubricating composition at the contact zone or the relative hardness of the metal. Generally, the deterioration of the tool can be measured as an amount of wear. Wear on the tool can result in a loss of sharpness so that cutting is made less efficient, or can result in change of the dimension of the tool so that the tool is no longer suitable for use in the metalworking operation. It is generally desirable to prolong the life of the tool during metalworking operations by reducing the amount of wear.

The metalworking lubricants of the invention cool the workpiece and the tool by heat transfer. The additives in the lubricant compositions also provide for reducing friction at the point of contact, and the extreme pressure additives prevent welding or catastrophic failure at high temperatures or pressures. Under mild levels of load or speed, boundary conditions prevail while at more extreme conditions extreme pressure additives in the fluid react with the metal on the tool and/or workpiece to form a tough film that is not destroyed under the high load/temperature/pressure regime. In one aspect, the tough film is sacrificial and renewable—as wear removes the film, the film reforms on the metal surface by action of sulfur in the lubricating compositions.

During metalworking operations, the lubricating fluids of the invention are applied to the contact zone between tool and workpiece. The fluids may be applied by a variety of methods, including immersing the contact zone in the fluid, spraying the fluid into the contact zone, flooding the contact zone with fluid, pumping a stream of fluid into the contact zone, periodically wetting the tool or the workpiece with lubricating fluid, or any means of constantly or intermittently applying the lubricant to the contact zone between the tool and the workpiece.

In a preferred embodiment, lubricating compositions of the invention are used in various operations. Gear forming or cutting operations include broaching, hobbing, shaping, and honing (finish operations). Broaching includes both stick broaching (internal gears) and pot broaching (external gears). Hobbing includes both rough and finish or final form types. Shaving and honing includes all gear finish shaving and honing operations. Other operations include, without limitation, spline applications, threading, thread rolling, and thread forming.

A mechanism to form spline like teeth is flow forming. Flow forming is a specialized operation using extremely high pressures.

Non-limiting examples of workpiece materials include SAE gear steel numbers 1030, 1045, 1320, 2317, 2345, 3115, 3120, 3145, 3150, 3310, 4023, 4027, 4032, 4119, 4125, 4320, 4340, 4615, 4620, 4640, 4815, 4820, 5140, 5150, 6150 and SAE spline shaft steel numbers 1045, 1320, 2340, 2345, 3115, 3120, 3135, 3140, and 4023. Other information on suitable materials and methods of gear cutting and other metalworking operations is given in Machinery's Handbook, for example the 23$^{rd}$ edition published in 1989 by Industrial Press, New York, the disclosure of which is incorporated by reference.

The invention has been described above with respect to various preferred embodiments. Further non-limiting illustrations are given in the examples below.

EXAMPLES

Test fluids are formulated, from Mayco base 4220, Mayco base 1536, a sulfurized lard oil, and a non-sulfurized lard oil. The Mayco bases and the lard oils are available from Dover Chemical Corporation. Base 4220 contains 18% total sulfur and 6% active sulfur. Inactive sulfur is 12%—the difference between total sulfur and active sulfur. Chemically, it contains a mixture of sulfurized esters about 33% by weight of sulfurized lard oil. Mayco base 1536 is a polysulfide containing 36.5% total sulfur and 33% active, resulting in an inactive sulfur content of 3.5%. It contains no sulfurized lard oil. The sulfurized lard oil contains 10% total sulfur, all of it inactive according to ASTM D-1552 and D-1662. The lard oil used in the formulations contains no sulfur. Fat in the formulations is thus contributed by the lard and the sulfurized lard components, as well as the sulfurized lard present in Mayco base 4022. The two Mayco bases contribute active sulfur and available sulfur as determined according to ASTM D-1552 and D-1662, and as corrected in the case of 4220 for its content of sulfurized lard. As discussed in the specification, sulfurized lard contributes to total sulfur but does not contribute to available sulfur.

Table 1 gives the formulations in weight percent of base 4220, base 1536, percent of sulfurized lard oil, and percent of lard. In addition, the fluids contain a standard corrosion and antioxidant additive, with the remainder being mineral oil.

TABLE 1

| Example | Percent (%) Base 4220 | Percent (%) Base 1536 | Percent (%) Sulfurized lard oil | Percent (%) Lard |
|---|---|---|---|---|
| 1 | 0 | 3.27 | 14.87 | 0 |
| 2 | 10 | 2 | 0 | 4.5 |
| 3 | .675 | 4.24 | 0 | 9.56 |
| 4 | 0 | 4.36 | 1.07 | 2.04 |
| 5 | 0 | 1.42 | 12.6 | 0 |
| 6 | 0 | 0.67 | 13.77 | 0 |
| 7 | 6.5 | 0 | 0 | 4.7 |
| 8 | 2 | 0.5 | 0 | 1.9 |

Table 2 gives, for the same formulations as in Table I, the level of fat, active sulfur, and available sulfur, as well as the ratio of the active sulfur to the available sulfur. The last column gives the wear in the gear cutting operation discussed below. As noted, percent fat corresponds to the total percent by weight of lard or sulfurized lard oil, including any that is added as a component of base 4220. Active sulfur is calculated from the level of the additives in view of the known active sulfur content of each of the additives. Available sulfur is calculated by subtracting from inactive sulfur any inactive sulfur that is contributed by sulfurized lard oil, either as a separate additive or as a component of base 4220. The ratio of active sulfur to available sulfur has been calculated from the values in column 3 and 4. Finally, the ratio of fat to the sum of active sulfur and available sulfur is given in column 6.

TABLE 2

| Example | Percent (%) fat | Percent (%) Active Sulfur | Percent (%) Available Sulfur | Active Sulfur/ Available Sulfur | Fat/ (S + S) | Wear |
|---|---|---|---|---|---|---|
| 1 | 13.4 | 1.08 | .114 | 9.4 | | 0.00530 |
| 2 | 7.8 | 1.26 | .94 | 1.34 | 3.5 | 0.00190 |
| 3 | 9.8 | 1.44 | .21 | 7.0 | | 0.00325 |
| 4 | 3.0 | 1.44 | .15 | 9.4 | | 0.00400 |
| 5 | 11.3 | .47 | .05 | 9.4 | | 0.00620 |
| 6 | 12.4 | .22 | .02 | 9.4 | | 0.00380 |
| 7 | 6.9 | .39 | .56 | .7 | 7.3 | 0.00205 |
| 8 | 2.6 | .285 | .19 | 1.5 | 5.5 | 0.00220 |

The gear cutting operation is carried out on an American Pfauter Hobbing machine model PE 80. The test blends of Examples 1 through 8 are applied to the contact zone between the tool and the workpiece at approximately 65 gpm and 25 psi. A pinion gear made of 5130H steel is cut with a class A hob cutter made of Rex 76, with a Rockwell C hardness 64.0-66.0, and a titanium nitride coating. Operating conditions are: spindle rpm=688, axial feed=2.2, feed rate first=2.2, and shift rate=0.025. Wear on the tool is determined by a change in dimensions (expressed in the Table in units of inches) after 6,000 pieces are cut.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A metalworking lubricant composition comprising
a lubricating base oil,
less than 10 ppm Cl,
less than 200 ppm P,
active sulfur at a level of A% by weight of the composition,
available sulfur at a level of B% by weight of the composition; and
fat at a level of C% by weight of the composition;
wherein C is 2 or higher, the sum of (A+B) is greater than or equal to about 0.4 and is less than or equal to about 2.4, C is 2.5 or more times greater than the sum of (A+B), and the value of A/B is about 0.5 to about 2.

2. A composition according to claim 1, wherein the value of A/B ranges from about 0.6 to about 1.6.

3. A composition according to claim 1, wherein the value of A/B ranges from about 0.7 to about 1.5.

4. A composition according to claim 1, wherein the sum of (A+B) is greater than or equal to about 0.8 and less than or equal to about 1.2.

5. A composition according to claim 1, wherein the sum of (A+B) is greater than or equal to about 1.8 and less than or equal to about 2.4.

6. A composition according to claim 1, wherein C is three times or greater than the sum (A+B).

7. A method of reducing wear on a metalworking tool in contact with a workpiece during a metal working operation, comprising lubricating the workpiece with an extreme pressure lubricant composition comprising
a lubricating base oil,
less than 10 ppm Cl,
less than 200 ppm P,
active sulfur at a level of A % by weight of the composition,
available sulfur at a level of B % by weight of the composition; and
fat at a level of C % by weight of the composition and C is 2 or higher; wherein the composition is selected to have:
i) a sum of (A+B) of about 1.8 to about 2.4, where C is about 6 to about 10 and A/B is about 1 to about 1.5; or
ii) a sum of (A+B) of about 0.8 to about 1.2, where C is about 5 to about 9 and A/B is about 0.5 to about 1.25; or
iii) a sum of (A+B) of about 0.4 to about 0.6, where C is about 2 to about 4 and A/B is about 0.5 to about 1.5.

8. A method according to claim 7, wherein the metal working operation comprises gear cutting.

9. A method according to claim 7, wherein the tool comprises a hobbing tool.

10. A method according to claim 7, wherein the tool comprises a steel with a titanium nitride coating.

11. A method according to claim 7, wherein the value of A/B is in the range of about 0.6 to about 1.6.

12. A method according to claim 7, wherein the sum of (A+B) is from about 1.8 to about 2.4, C is from about 6 to about 10, and A/B is from about 1 to about 1.5.

13. A composition according to claim 1, wherein (A+B) is from about 0.8 to about 1.2, C is from about 5 to about 9, and A/B is from about 0.5 to about 1.25.

14. A composition according to claim 1, wherein (A+B) is from about 0.4 to about 0.6, C is from about 2 to about 4, and A/B is from about 0.5 to about 1.5.

15. A method of reducing wear on a hobbing tool during a gear cutting operation on a workpiece, wherein the hobbing tool comprises a machine tool steel coated with a titanium nitride wear coating, the method of comprising
applying a lubricant composition to the zone of contact between the hobbing tool and the workpiece; and
removing metal from the workpiece by the cutting action of the tool, wherein the lubricant composition comprises
a lubricating base oil,
less than 10 ppm Cl,
less than 200 ppm P,
active sulfur at a level of A % by weight of the composition,
available sulfur at a level of B % by weight of the composition; and
fat at a level of C % by weight of the composition and C is 2 or higher; wherein the composition is selected to have:
i) a sum of (A+B) of about 1.8 to about 2.4, where C is about 6 to about 10 and A/B is about 1 to about 1.5; or
ii) a sum of (A+B) of about 0.8 to about 1.2, where C is about 5 to about 9 and A/B is about 0.5 to about 1.25; or
iii) a sum of (A+B) of about 0.4 to about 0.6, where C is about 2 to about 4 and A/B is about 0.5 to about 1.5.

16. A method according to claim 15, wherein C is from 2 to 3, (A+B) is from about 0.4 to about 0.6, and A/B is from about 1.25 to about 1.75.

17. A method according to claim 15, wherein C is about 2.6, A is about 0.3, and B is about 0.2.

18. A composition according to claim 1, wherein C is from about 6 to about 8, (A+B) is from about 0.9 to about 1.2, and A/B is about 0.5 to 1.

19. A composition according to claim 18, wherein C is about 6.9, A is about 0.4, and B is about 0.6.

20. A composition according to claim 1, wherein C is from about 7 to about 9, (A+B) is from about 2 to about 2.4, and A/B is from about 1.0 to about 1.5.

21. A composition according to claim 20, wherein C is about 7.8, A is about 1.3, and B is about 0.9.

22. A method of formulating a gear cutting lubricant by admixing a lubricant base oil and one or more lubricant components comprising selecting one or more lubricant components that contain known levels of at least one of active sulfur as determined by ASTM D-1552 and ASTM D-1662, inactive sulfur defined as total sulfur minus active sulfur, and fat defined as the percent weight content of unsaturated fats, saturated fats, sulfurized unsaturated fats, and/or sulfurized saturated fat in the component;

for each component calculating a level of available sulfur by subtracting active sulfur from total sulfur to obtain inactive sulfur, then further subtracting the amount of inactive sulfur, if any, supplied by a sulfurized saturated fat;

combining the lubricant components at levels calculated to give a total fat level in the lubricant composition of at least about 2% by weight, a sum of active sulfur and available sulfur of greater than or equal to about 0.4% and less than or equal to about 2.4% by weight and a balance of sulfur such that the ratio of the level of active sulfur to the level of available sulfur is from about 0.5 to about 2, and a ratio of fat to the sum of active sulfur plus available sulfur of greater than or equal to about 2.5.

23. A method according to claim 22, wherein the ratio of active sulfur to available sulfur is about 0.6 to about 1.6.

24. A method according to claim 22, wherein the sum of active sulfur and available sulfur is greater than or equal to about 0.8 and less than or equal to about 1.2.

25. A method according to claim 22, wherein the sum of active sulfur and available sulfur is greater than about 2.

26. A metalworking lubricant composition comprising a lubricating base oil, less than 10 ppm Cl, less than 200 ppm P, active sulfur at a level of A % by weight of the composition, available sulfur at a level of B % by weight of the composition; and fat at a level of 0% by weight of the composition;

wherein C is 2 or higher, the sum of (A+B) is greater than or equal to about 0.8 and less than or equal to about 1.2, and the value of A/B is about 0.5 to about 2.

* * * * *

UNITED STATES PATENT AND TRADEMARK OFFICE

CERTIFICATE OF CORRECTION

PATENT NO. : 7,645,727 B2
APPLICATION NO. : 11/116931
DATED : January 12, 2010
INVENTOR(S) : Harris et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1265 days.

Signed and Sealed this

Sixteenth Day of November, 2010

David J. Kappos

David J. Kappos
*Director of the United States Patent and Trademark Office*